United States Patent [19]

Yamada et al.

[11] Patent Number: 4,591,780

[45] Date of Patent: May 27, 1986

[54] CONSTANT CURRENT SOURCE DEVICE HAVING A RATIO METRICITY BETWEEN SUPPLY VOLTAGE AND OUTPUT CURRENT

[75] Inventors: Kazuji Yamada, Hitachi; Ryoichi Kobayashi, Ibaraki; Yasuo Nagai, Maebashi; Isao Shimizu, Gunma; Kanji Kawakami, Mito, all of Japan

[73] Assignee: Hitachi, Ltd., Tokyo, Japan

[21] Appl. No.: 559,467

[22] Filed: Dec. 8, 1983

[30] Foreign Application Priority Data

Dec. 10, 1982 [JP] Japan ..... 57-217597

[51] Int. Cl.[4] ..... G05F 3/20

[52] U.S. Cl. ..... 323/313; 323/316

[58] Field of Search ..... 323/281, 313, 314, 315, 323/316

[56] References Cited

U.S. PATENT DOCUMENTS 4,118,712 10/1978 Kawasaki ..... 323/313 X
4,292,584 9/1981 Kusakabe ..... 323/316
4,446,419 5/1984 van de Plassche et al. ..... 323/316

FOREIGN PATENT DOCUMENTS 58-82319 5/1983 Japan ..... 323/313

*Primary Examiner*—Patrick R. Salce

*Assistant Examiner*—D. L. Rebsch

*Attorney, Agent, or Firm*—Antonelli, Terry & Wands

[57] ABSTRACT

A current source device controls a rate of change of current flowing through a load so that the change rate of the current is equal to a change rate of a fluctuating supply voltage. A first transistor is fed with the supply voltage via a first resistor connected to its collector and a second resistor connected to its emitter. A second transistor has a base connected to a base of the first transistor, an emitter connected to a third resistor and a collector connected to a load. A current to the load is fed from the supply voltage via the load, the collector and emitter of the second transistor and the third resistor. The collector and base of the first transistor are respectively connected to a base and an emitter of a third transistor having a collector fed with the supply voltage. The ratio between a voltage drop caused across the second resistor by a reference current flowing through the first resistor, the collector and emitter of the first transistor and the second resistor, and a voltage drop caused across the third resistor by an emitter current of the second transistor, which is substantially equal to a collector current of the second transistor flowing through the load, is set to a predetermined value. The emitter area of the second transistor is enlarged beyond that of the first transistor to obtain a sufficiently large output current.

9 Claims, 8 Drawing Figures

CONSTANT CURRENT SOURCE DEVICE HAVING A RATIO METRICITY BETWEEN SUPPLY VOLTAGE AND OUTPUT CURRENT

BACKGROUND OF THE INVENTION

1. Field of the Invention

This invention generally relates to current source devices and more particularly to a current source device adapted to supply a predetermined amount of current to a load irrespective of the magnitude of the load.

In the event that a supply voltage to a current source device fluctuates when supplying a constant current from the device to a load, it has been desirable to change the constant current at the same rate of change as that of the supply voltage. Such an expedient will be described by referring, by way of example, to a semiconductor pressure transducer used for measurement of pressure of a mixture (gasoline plus air) supplied to a car engine. The semiconductor pressure transducer is known, in which a thin diaphragm is formed at the center of a silicon single crystal plate, gauging resistors are formed on the surface of the diaphragm by impurity diffusion layers, and the gauging resistors are connected to form a sensor of a bridge circuit. The semiconductor pressure transducer is usually connected to a constant current source device and driven by a constant current. Accordingly, the output voltage of the semiconductor pressure transducer is proportional to the current supplied to the bridge circuit. The output voltage of the semiconductor pressure transducer is amplified at an amplifier, and the amplified output signal is digitized at an A/D converter. In this manner, an analog quantity representative of a pressure of the mixture produced from the semiconductor pressure transducer is converted into a digital value. The constant current source device, amplifier and A/D converter are all driven by a battery carried in a car or by a DC voltage which is converted from an output voltage of the battery by means of a DC-to-DC converter. The driving voltage, however, fluctuates, depending on such factors as the charged state of the battery and the magnitude of load on the battery. Generally, the A/D converter performs A/D conversion referenced to a supply voltage fed to the A/D converter. Accordingly, a decrease in the supply voltage, for example, leads to a decrease in the reference voltage for the A/D converter, with the result that the output of the A/D converter increases beyond a correct value, even if the voltage of the input signal to the A/D converter remains unchanged. In order to obtain a correct output, therefore, it is required that the amount of current fed from the constant current supply device to the pressure transducer be reduced at the same rate as that of the decrease of the driving voltage.

2. Description of the Prior Art

Various types of current supply circuits in the form of integrated circuits have hitherto been available. A typical example of a prior art current supply circuit is illustrated in a circuit diagram of FIG. 1, which may be referred to in "Analysis and Design of Analog Integrated Circuits" by Paul R. Grey and Robert G. Meyer, published by John Wiley & Sons (1977), pp. 200, 201, 206, 207, 236 and 273, for example.

As shown, a resistor 1 has one end connected to a supply voltage Vcc and the other end connected to the collector of a transistor 11. The transistor 11 has an emitter connected to a common power supply line via a resistor 3 and a base short-circuited to its collector. A transistor 12 has a base connected to the base of the transistor 11, an emitter connected to the common power supply line via a resistor 2 and a collector connected to a terminal 22. A load (not shown) may be connected between a terminal 21 connected to the supply voltage Vcc and the terminal 22, and an output current Ic serving as a load current is fed to the load.

The operation of this circuit will now be described. If the transistors 11 and 12 have such large current-amplification factors $\beta_{11}$ and $\beta_{12}$ that the base current can be neglected (this assumption is valid for primary approximation since NPN transistors generally have a current-amplification factor $\beta$ of 100 or more), the output current Ic can be expressed as, $$Ic = \frac{1}{R_2}\left[Iref\,R_3 + V_T l_n\left(\frac{I_{s12}}{I_{s11}}\right)\left(\frac{Iref}{Ic}\right)\right] \quad (1)$$

where $V_T$: $V_T = kT/q$ (K, T and q will be described later)

$I_{s11}$: saturation current of transistor 11

$I_{s12}$: saturation current of transistor 12

$R_2$: resistance of resistor 2

$R_3$: resistance of resistor 3

The second term in brackets "[ ]" represents a difference voltage between the base/emitter voltages of the transistors 11 and 12 and this difference voltage amounts to 150 mV, at the most, for a current ratio of about 100. Since, in general applications, Iref.$R_3$ is set to be sufficiently larger than the value of the difference voltage, the output current Ic can be approximated by the following equation:

$$Ic \simeq Iref\left(\frac{R_3}{R_2}\right) \quad (2)$$

Considering operations characteristic of the FIG. 1 circuit, it should be understood that the transistors 11 and 12 have an equal emitter voltage, and that Ic changes in proportion to changes of Iref.

In connection with the current source circuit shown in FIG. 1, so-called ratio metricity will now be discussed which characterizes a relationship in which the output current changes at the same rate of change as that of the supply voltage Vcc. Denoting the base/emitter voltage of the transistor 11 by $V_{BE11}$, the current Iref is written as, $$Iref = \frac{Vcc - V_{BE11}}{R_1 + R_3} \quad (3)$$

whereas $R_1$ is a resistance of the resistor 1. Accordingly, a rate of change of Iref, designated by $\gamma$, is related to a rate of change of Vcc, designated by $\xi$, as follows:

$$Iref(1+\gamma) \simeq \frac{Vcc(1+\xi) - V_{BE11}}{R_1 + R_3}$$

$$= \frac{Vcc - V_{BE11}}{R_1 + R_3}\left(1 + \frac{\xi\,Vcc}{Vcc - V_{BE11}}\right)$$

Therefore, $$\gamma = \frac{\xi\, Vcc}{Vcc - V_{BE11}} \quad (4)$$

Since, in equation (4), $Vcc > Vcc - V_{BE11}$ stands, the rate of change $\gamma$ of Iref is always larger than the rate of change $\xi$ of Vcc. As a result, there is no ratio metricity between Vcc and Iref. The ratio metricity between Vcc and Iref is defined so that the change rate $\gamma$ of Iref equals the change rate $\xi$ of Vcc. Considering that the transistors 11 and 12 in the FIG. 1 circuit are connected in a so-called current mirror fashion and the output current Ic is in proportion to Iref, as will be seen from equation (2), ratio metricity is also excluded between the supply voltage Vcc and the output current Ic.

SUMMARY OF THE INVENTION

An object of this invention is to provide a current source device in which, when a supply voltage fluctuates, an output current to be passed through a load can change at substantially the same rate of change as that of the supply voltage.

Another object of this invention is to provide a current source device in which, when a supply voltage fluctuates, an output current to be passed through a load can change at substantially the same change rate as that of the supply voltage and in which the output current can be sufficiently large.

According to one aspect of the invention, a first transistor is connected, via a first resistor connected with its collector and a second resistor connected with its emitter, across a DC power supply which feeds a fluctuating supply voltage. The base of a second transistor is connected to the base of the first transistor. The second transistor has an emitter connected to a third resistor and a collector connected to a load, and the supply voltage feeds a current to the load via the load, the collector and emitter of the second transistor and the third resistor. A third transistor has its base and emitter connected to the collector and the base of the first transistor, respectively. The collector of the third transistor is fed with the supply voltage. The ratio between a voltage drop across the second resistor (i.e., emitter voltage of the first transistor) caused by a reference current flowing through the first resistor, the collector and emitter of the first transistor and second resistor and a voltage drop across the third resistors (i.e., emitter voltage of the second transistor) caused by an emitter current of the second transistor which substantially equals a collector current of the second transistor flowing through the load is set to a predetermined value.

According to another aspect of the invention, the emitter area of the second transistor is enlarged to a predetermined multiple of the emitter area of the first transistor, and the resistance of the third resistor is set to a fraction of the predetermined multiple of the resistance which the third resistor otherwise has when the emitter areas are equal to each other, whereby the collector current of the second transistor flowing through a load can be enlarged to a predetermined multiple of the collector current otherwise flowing through the load when the emitter areas are equal to each other, and the enlarged collector current can change at substantially the same change rate as that of a supply voltage fed from a DC power supply to the load.

DESCRIPTION OF THE PREFERRED EMBODIMENTS

Figure 2:
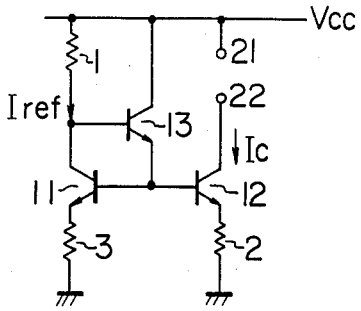
FIG. 2 PRIOR ART
Figure 3:
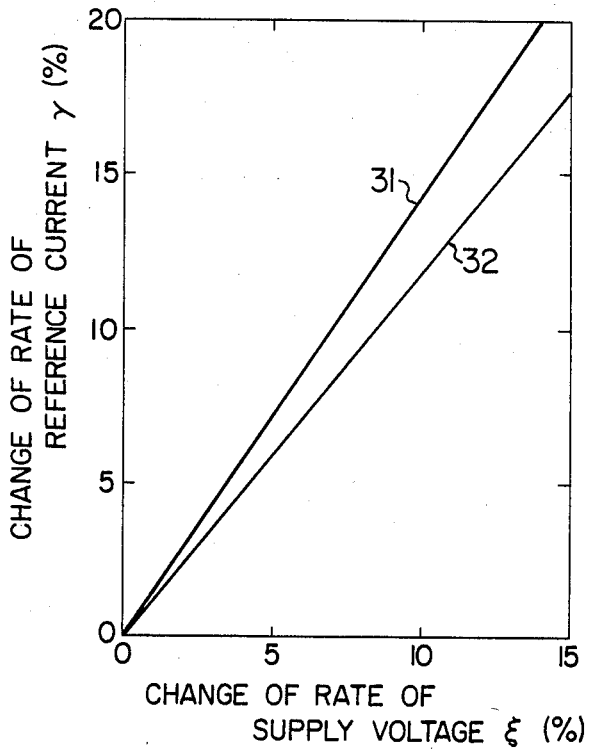
FIG. 3 is a graph showing the relation between rate of change of supply voltage and rate of change of reference current.
Figure 4:
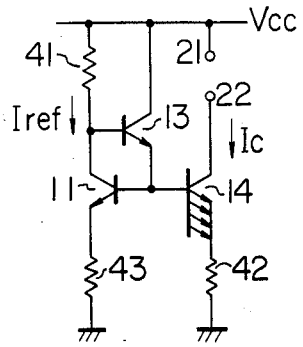
FIG. 4 is a schematic circuit diagram showing one embodiment of the invention.
Figure 6:
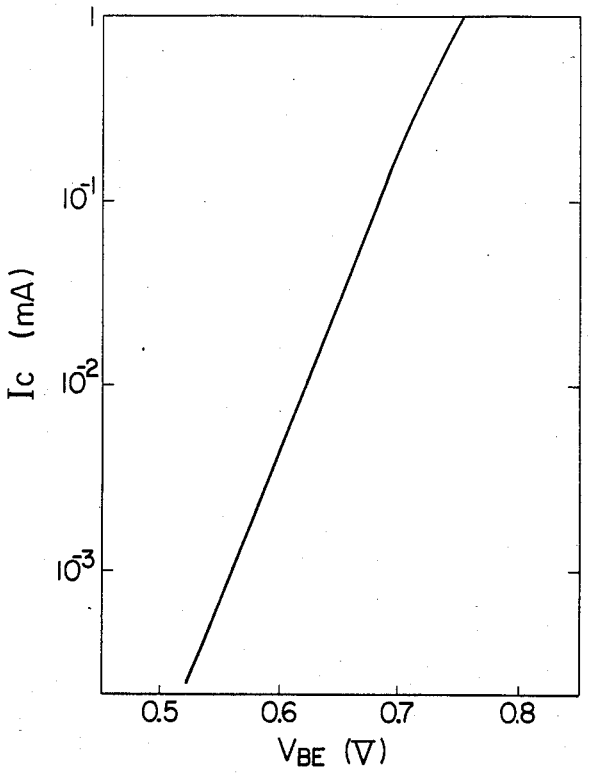
FIG. 6 is a graph showing a $V_{BE}$-Ic characteristic of a transistor.
Figure 7:
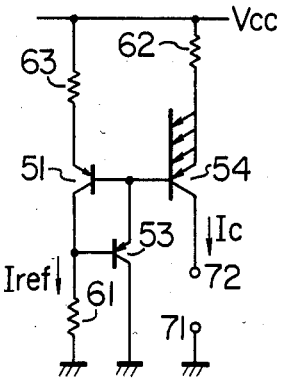
FIG. 7 is a schematic circuit diagram showing another embodiment of the invention.

The invention will now be described by way of example with reference to FIGS. 2 to 7 of which FIGS. 4 and 7 show current supply circuits according to preferred embodiments of the invention. In FIGS. 2, 4, and 7, like elements are designated by like reference numerals.

Prior to describing the preferred embodiments of the invention, the rate of change of a supply voltage and that of a reference current in a typical prior art constant current source circuit will first be described with reference to FIG. 2. A circuit similar to this prior art circuit is disclosed in "Analysis and Design of Analog Integrated Circuit" set forth previously.

Figure 1:
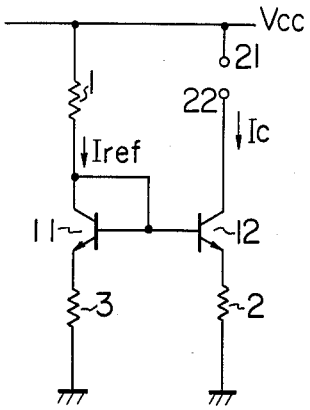
FIG. 1 PRIOR ART
FIGS. 1 and 2 are schematic circuit diagrams of prior art current supply circuits.

While in the FIG. 1 circuit the base and collector of the transistor 11 are short-circuited, the transistor 11 in the FIG. 2 circuit has base and collector connected via a transistor 13. Thus, the transistor 13 has a base connected to the collector of the transistor 11, an emitter connected to the base of the transistor 11, and a collector connected to a supply voltage Vcc. Because of the provision of the transistor 13, the base currents of transistors 11 and 12 are fed from the supply voltage Vcc via the collector and emitter of the transistor 13. Accordingly, a current flowing into the base of the transistor 13 by way of a junction between the collector of the transistor 11 and a resistor 1 for the purpose of driving the transistor 13 is $1/\beta$ ($\beta$: current-amplification factor of the transistor 13) of a current to be passed to the bases of the transistors 11 and 12, meaning $1/\beta$ of a current which would flow into the bases of the transistors 11 and 12 by way of the junction of the transistor 11 and resistor 1 when the collector and base of the transistor 11 are directly coupled. As a result, the linearity between a current flowing through the resistor 1 (i.e., a sum of collector current of the transistor 13) and the collector current of the transistor 12 can be improved drastically as compared to the corresponding linearity obtained with the collector and base of the transistor 11 being directly connected. Putting the above point aside, the construction of the FIG. 2 circuit is the same as that of the FIG. 1 circuit. The circuit shown in FIG. 2 is a current source circuit which takes into consideration the current-amplification factor $h_{FE}$ of a transistor, and the reference current Iref flowing through the resistor 1 can be expressed by the following equation which corresponds to equation (3):

$$Iref \simeq \frac{Vcc - V_{BE11} - V_{BE13}}{R_1 + R_3} \quad (5)$$

where

Vcc: supply voltage $V_{BE11}$: base/emitter voltage of transistor 11

$V_{BE13}$: base/emitter voltage of transistor 13

$R_1$: resistance of resistor 1

$R_3$: resistance of resistor 3

The relation between a rate of change $\xi$ of supply voltage ($=\Delta Vcc/Vcc$) and a rate of change $\gamma$ of reference current Iref ($=\Delta Iref/Iref$) in the FIG. 2 circuit is graphically shown in FIG. 3 where a linear line 31 is for Vcc=5.1 and $V_{BE11}$30 $V_{BE13}$=1.4 V and a linear line 32 is for Vcc=10 V and $V_{Be11}+V_{BE13}$= 1.4 V. The results illustrated in FIG. 3 show that as the supply voltage Vcc decreases, the ramp of the linear line becomes greater than 1 (one), thus degrading the identity between the change rate $\xi$ of Vcc and the change rate $\Gamma$ of Iref. It will therefore be seen that in order to ensure ratio metricity between the collector current Ic of the transistor 12 and the supply voltage Vcc, the rate of change of the collector current Ic must be smaller than that of the reference current Iref so that the influence of the change rate $\gamma$ of Iref, which increases as the supply voltage Vcc decreases, can be cancelled out.

Referring now to FIG. 4, one embodiment of a current source device according to the invention will be described. At a glance, the circuit of FIG. 4 resembles the FIG. 2 circuit but it is based on a different operational principle.

In the construction of FIG. 4, a transistor 14 corresponding to the transistor 12 of FIG. 2 has an emitter area larger than that of the transistor 11. The transistor 11 has a collector connected to a fluctuating supply voltage Vcc via a resistor 41, an emitter connected to a common power supply line via a resistor 43 and a base connected to a base of the transistor 14. The collector and base of the transistor 11 are respectively connected to base and emitter of a transistor 13 as in the FIG. 2 circuit construction, with the collector of the transistor 13 connected to the supply voltage Vcc. The transistor 14 has an emitter connected to the common power supply line via a resistor 42 and a collector connected to a terminal 22, and a load (not shown) is to be connected between terminals 21 and 22.

For clarity of operational description, it is now assumed that each of the transistors has a current-amplification factor $h_{FE}$ which is practically infinite, the $h_{FE}$ is about 100 and the above assumption will not change the essence of the present invention.

Equality of base potential for the transistors 11 and 14 leads to the following equation:

$$V_{BE11}+Iref \cdot R_{43}=V_{BE14}+Ic \cdot R_{42} \quad (6)$$

where

Ic: collector current (or emitter current) of transistor 14

Iref: reference current in the collector of transistor 11

$V_{BE14}$: base/emitter voltage of transistor 14

$R_{42}$: resistance of resistor 42

$R_{43}$: resistance of resistor 43

Pursuant to the Ebers-Moll model, equation (6) is rewritten into, $$\frac{kT}{q} \ln \frac{Iref}{I_{s11}} + Iref \cdot R_{43} = \frac{kT}{q} \ln \frac{Ic}{I_{s14}} + Ic \cdot R_{42} \quad (7)$$

Equation (7) is then transformed into, $$\frac{kT}{q} \ln \frac{Iref}{Ic} \cdot \frac{I_{s14}}{I_{s11}} + Iref \cdot R_{43} - Ic \cdot R_{42} = 0 \quad (8)$$

where k: Boltzmann's constant ($8.6\times10^{-5}$ eV/K)

T: absolute temperature q: amount of electric charge $I_{s11}$: saturation current of transistor 11

$I_{s14}$: saturation current of transistor 14

In general, since the saturation current is in proportion to the emitter area, $$\frac{I_{s14}}{I_{s11}} = \Gamma \quad (9)$$

can be defined.

Assume now that as the supply voltage Vcc changes to Vcc·(1+$\xi$), the reference current Iref changes to Iref·(1+$\Gamma$). The present invention then intends to cause the collector current Ic to change to Ic·(1+$\xi$) so that the rate of change of Ic is made equal to that of Vcc, thereby attaining the ratio metricity. To discuss this intention of the invention, assumption is made such that when the Vcc changes to Vcc·(1+$\xi$), the Iref and Ic change as follows:

$$\left.\begin{array}{l} Iref \rightarrow Iref\,(1+\gamma) \\ Ic \rightarrow Ic\,(1+\xi') \end{array}\right\} \quad (10)$$

By equations (10) and (8), $$\frac{kT}{q} \ln \frac{Iref\,(1+\gamma)}{Ic\,(1+\xi')}\,\Gamma + Iref\,(1+\gamma)R_{43} - Ic\,(1+\xi')R_{42} = 0 \quad (11)$$

is obtained. Then, equations (11) and (8) are combined, reducing to $$\frac{kT}{q} \ln \frac{1+\gamma}{1+\xi'} + Iref\,R_{43} - \xi'\,Ic\,R_{42} = 0 \quad (12)$$

Figure 5:
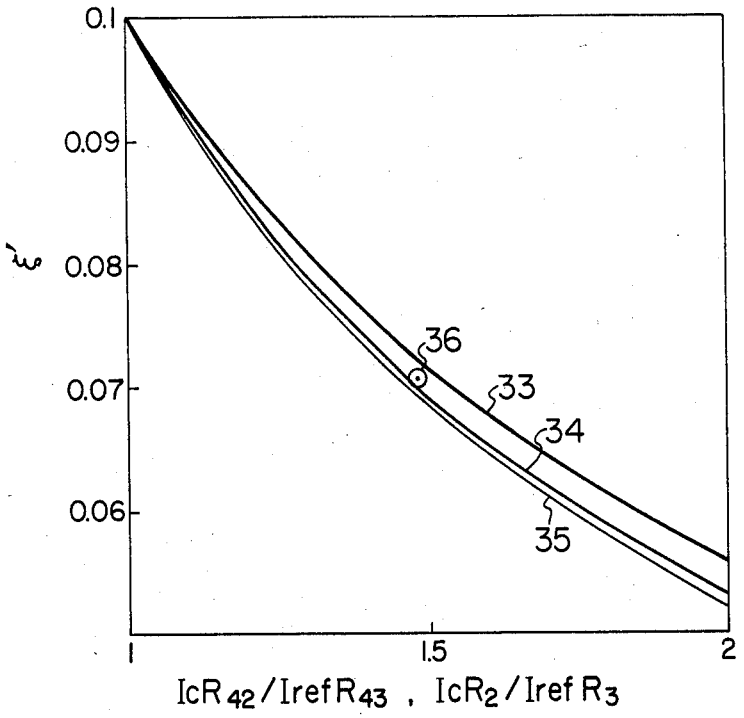
FIG. 5 is a graph useful in explaining the operation of the FIG. 4 circuit.

Pursuant to equation, (12), the relation between the emitter potential ratio Ic·$R_{42}$/Iref·$R_{43}$ for the transistors 11 and 14 and the change rate $\xi'$ is calculated to obtain results as graphically shown in FIG. 5. The following are conditions for the calculation.

(1) Supply voltage Vcc=5.1 V (2) Change rate $\gamma$ of Iref=10%. In accordance with the linear line 31 of FIG. 3, this value of the change rate $\gamma$ corresponds to 7% of the change rate $\xi$ of Vcc. It will be appreciated that the relation between the supply voltage change rate and the reference current change rate established for the FIG. 3 circuit can also be valid for the FIG. 4 circuit since a circuit, comprised of the transistors 11 and 13 and resistors 41 and 43, for participating in determination of the reference current Iref in the FIG. 4 circuit has the same construction as that of a circuit including the transistors 11 and 13 and the resistors 1 and 3 in the FIG. 2 circuit.

(3) Iref=1 mA for Vcc=5.1 V (4) Current-amplification factors $h_{FE}$ of the transistors 11 and 14 are infinite.

(5) Ambient temperature T (absolute temperature)=293 K.

In FIG. 5, curves 33, 34 and 35 are plotted for parameters $R_{43}=100\Omega$, $R_{43}=200\Omega$and $R_{43}=300\ \Omega$, respectively. The above condition (2) stipulates that in order to make the change rate $\xi'$ of output current Ic equal to the change rate $\xi$ of supply voltage, the change rate $\xi'$ must be 0.07. Accordingly, pursuant to the graphical representation of FIG. 5, the emitter potential ratio Ic $R_{42}$/Iref $R_{43}$ for the transistors 11 and 14 may be selected to be about 1.5 (Strictly, 1.48).

Experimentally, an encircled point 36 in FIG. 5 is determined for Iref=1mA, $R_{42}=1k\Omega$, $R_{43}=200\Omega$, and $\Gamma=10$. This point 36 slightly deviates from the calculated plotting owing to the fact that the $h_{FE}$ is finite practically. But the deviation is negligible for practical purposes.

The operation at the point 6 will be described in greater detail. Reference should first be made to FIG. 6 showing the relation between the base/emitter voltage $V_{BE11}$ and collector current Ic of the transistor 11, which relation is obtained with the emitter area of the transistor 14 being ten times the emitter area of the transistor 11 for $\Gamma=10$. Because of the enlargement of the emitter area, the transistor 14 is equivalent to a parallel connection of ten transistors as represented by reference numeral 11, and it is possible to consider that an amount of current of Ic/10 flows into a partial emitter area of transistor 14 which is equal to the entire emitter area of the transistor 11. Accordingly, the relation between the base/emitter voltage $V_{BE14}$and collector current Ic of the transistor 14 may also be derived from FIG. 6 by using 1/10 of a collector current flowing through the transistor 14.

Since the collector current of the transistor 11 is 1 mA as given previously, a voltage drop of 0.2 V is caused across the resistor 43 and the FIG. 6 characteristic provides a base/emitter voltage $V_{BE11}$ of transistor 11 which is 0.75 V. Consequently, the base potential of the transistor 11 becomes 0.95 V. Thus, following the aforementioned requirement that the emitter potential ratio Ic $R_{42}$/Iref $R_{43}$ for the transistors 11 and 14 be 1.48, the emitter potential of the transistor 14 becomes 0.296 V (=0.2 V×1.48) and consequently, the collector current Ic becomes $2.96=10^{-2}$ mA (=0.296 V/1 kΩ).

When teachings of the present invention are applied to the current source circuit shown in FIG. 2 to determine the ratio Ic $R_2$/Iref $R_3$ under a condition that Vcc=10 V, the ratio is required to be about 1.2 pursuant to the characteristics of FIG. 5 since a change rate $\xi$ of Vcc corresponding to 10% of the change rate of Iref is 8.4% pursuant to the linear line 32 of FIG. 3

This example proves that a similar effect can be obtained for attainment of ratio metricity when the emitter areas of the transistors 11 and 14 are equal. In this case, however, the emitter area of the transistor 12 is 1/10 of that of the transistor 14 in the FIG. 4 embodiment with the result that the output current of the transistor 12 is only about 30 μA (=0.296 mA/10). The resistor 43 must have a resistance 10 kΩ which is ten times the resistance $R_{42}$ of the resistor 42 in the FIG. 4 embodiment so as to maintain an emitter potential of 0.296 V for the transistor 12. In contrast to the aforementioned example, according also to the present invention, the emitter area of the transistor 14 is enlarged beyond the emitter area of the transistor 11, thereby ensuring delivery of a sufficiently large output current Ic.

In the embodiment shown in FIG. 4, the collector and base of the transistor 11 are connected via the base and emitter of the transistor 13 but they may be connected directly as in the circuit of FIG. 1. Further, in the FIG. 4 embodiment, the load is fed with current from the supply voltage Vcc of a power supply for the current source circuit but the current feed to the load may be effected from a separate power supply. In other words, it is not always necessary that a common power supply is shared by the current source circuit and the load. With two independent power supplies used, identical-polarity output terminals of the individual power supplies are obviously connected to the common power supply line.

FIG. 7 shows another embodiment of a current source circuit according to the invention wherein PNP transistors are used. As shown, a transistor 51 has an emitter connected to a supply voltage Vcc via a resistor 63, a collector connected to a common power supply line via a resistor 61 and a base connected to the base of a transistor 54. The transistor 54 has an emitter connected to the supply voltage via a resistor 62 and a collector connected to a terminal 72. A transistor 53 has an emitter connected to the base of the transistor 51, a base connected to the collector of the transistor 51 and a collector connected to the common power supply line. A load (not shown) is to be connected between the terminal 72 and a terminal 71 connected to the common power supply line. The transistor 54 has an emitter area which is enlarged beyond that of the transistor 51. The thus constructed circuit operates in the same manner as the FIG. 4 circuit.

Figure 8:
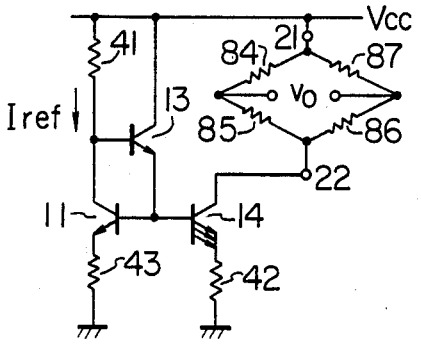
FIG. 8 is a circuit diagram showing an application of the current source circuit according to the invention.

As has been described, according to the invention, the ratio (emitter potential ratio) between a voltage drop caused by the reference current Iref across a resistor connected to the emitter of a transistor through which the reference current Iref flows and a voltage drop caused by the output current Ic across a resistor connected to the emitter of a transistor through which the output current flows is set to a value which makes substantially equal the change rate $\xi$ of supply voltage Vcc and the change rate $\xi'$ of output current Ic. In addition, the emitter area of the transistor through which the output current flows is made larger than that of the transistor through which the reference current flows, whereby the equality of the change rates of the supply voltage and output current can be established without decrease in the output current of the current supply circuit FIG. 8 shows a circuit to which the current source circuit of the present invention is applied. In this circuit, a circuit comprising resistors 41 to 43 and transistors 11, 13 and 14 constitutes a current source device according to the present invention, and a circuit comprising resistors 84 to 87 and connected between terminals 21 and 22 constitutes a bridge circuit serving as a temperature or pressure transducer. An output voltage Vo of the transducer is often required to be ratio metric to a supply voltage Vcc as described previously. With the FIG. 8 device, the drive current of the bridge circuit having the resistors 84 to 87 can be ratio metric to the Vcc and consequently, the output voltage Vo can also be ratio metric to the Vcc. Further, the drive current can be enlarged to increase the output voltage Vo. As described above, the present invention is advantageous in that the output current can have the same change rate as that of the supply voltage, and that the output current can be enlarged.

We claim:

1. A current source device to be connected to a first DC power supply, which may provide a fluctuating DC voltage, for supplying a predetermined amount of current to a load irrespective of the magnitude of the load comprising:

a first terminal to be connected to a first polarity output of said power supply;

a second terminal to be connected to a second polarity output of said power supply;

a first transistor having a collector and a base which are electrically connected together;

first resistor means having one end connected to said first terminal and the other end connected to the collector of said first transistor;

second resistor means having one end connected to an emitter of said first transistor and the other end connected to said second terminal;

a second transistor having a base connected to the base of said first transistor;

third resistor means having one end connected to an emitter of said second transistor and the other end connected to said second terminal; and a third terminal connected to a collector of said second transistor, said first terminal and said third terminal to be connected to respective ends of said load, the ratio between a first voltage drop produced across said second resistor means by an emitter current (Iref) of said first transistor flowing through said first resistor means, the collector and emitter of said first transistor and said second resistor means and a second voltage drop produced across said third resistor means by an emitter current of said second transistor which is substantially equal to a collector current (Ic) of said second transistor flowing through said load, the collector and emitter of said second transistor and said third resistor means being set to a predetermined value, whereby the predetermined amount of a current (Ic) flowing through said load changes at a rate of change which is substantially equal to a rate of change of the voltage of said first power supply, said predetermined value of said ratio $Ic \cdot R_{42}/Iref \cdot R_{43}$ between said first and second voltage drops being determined by the following equation when the voltage of said first DC power supply fluctuates at a rate of change $\xi$:

$$\frac{kT}{q} \ln \frac{1+\gamma}{1+\xi'} + \gamma \cdot Iref \cdot R_{43} - \xi' \cdot Ic \cdot R_{42} = 0$$

where k: Boltzmann's constant ($8.6 \times 10^{-5}$ eV/k)

T: ambient temperature (absolute temperature)

q: amount of electric charge $\gamma$: change rate at which the emitter current (Iref) changes with the fluctuation of the voltage of said first DC power supply at the change rate $\xi$ $\xi'$: change rate of the collector current (Ic) of said second transistor which is set to be equal to said change rate $\lambda$ $R_{42}$: resistance of said third resistor means $R_{43}$: resistance of said second resistor means.

2. A current source device according to claim 1 wherein one end of said load is to be connected to a first polarity output of a second DC power supply having a second polarity output to be connected to said second terminal, and said predetermined amount of current is fed from said second DC power supply.

3. A current source device according to claim 1 wherein said second transistor has an emitter area which is enlarged to a desired multiple of an emitter area of said first transistor and said third resistor means has a resistance which is set to a fraction of said desired multiple of a resistance which said third resistor means otherwise has when the emitter areas of said first and second transistors are equal to each other, whereby the collector current (Ic) of said second transistor is enlarged to the desired multiple of a collector current which said second transistor otherwise has when the emitter areas of said first and second transistors are equal to each other.

4. A current source device according to claim 3 wherein the collector and base of said first transistor are directly connected together.

5. A current source device according to claim 4 wherein said first and second polarity output terminals comprise an anode and a cathode respectively, and each of said first and second transistors is of an NPN type.

6. A current source device according to claim 4 wherein said first and second polarity output terminals comprise a cathode and an anode, respectively, and each of said first and second transistors is of a PNP type.

7. A current source device according to claim 3 further comprising a third transistor having a base connected to the collector of said first transistor, an emitter connected to the base of said first transistor and a collector connected to said first terminal.

8. A current source device according to claim 7 wherein said first and second polarity output terminals comprise an anode and a cathode, respectively, and each of said first, second and third transistors is of an NPN type.

9. A current source device according to claim 7 wherein said first and second polarity output terminals comprise a cathode and an anode, respectively, and each of said first, second and third transistors is of a PNP type.

* * * * *